US007080542B2

(12) United States Patent
Chun et al.

(10) Patent No.: US 7,080,542 B2
(45) Date of Patent: Jul. 25, 2006

(54) PRESS MOUNTED CAM AND METHOD OF MANUFACTURE

(75) Inventors: Victor L. Chun, Walton Hills, OH (US); Frank Madej, Mentor, OH (US); Brian Russell, Sheridan, MI (US); Brian Lee Taylor, Medina, OH (US)

(73) Assignee: Danly IEM, LLC, Danley IEM LLC ( * ) Notice: Subject to any disclaimer, the term of this patent is extended or adjusted under 35 U.S.C. 154(b) by 0 days.

(21) Appl. No.: 11/060,082

(22) Filed: Feb. 16, 2005

(65) Prior Publication Data

US 2006/0101893 A1 May 18, 2006

Related U.S. Application Data

(60) Provisional application No. 60/629,147, filed on Nov. 18, 2004.

(51) Int. Cl.
*B21D 5/04* (2006.01)
*B26D 5/16* (2006.01)

(52) U.S. Cl. ..... 72/452.9; 72/315; 83/588

(58) Field of Classification Search ..... 72/313, 72/315, 452.09; 83/588
See application file for complete search history.

(56) References Cited

U.S. PATENT DOCUMENTS

| | | | | |
|---|---|---|---|---|
| 5,231,907 | A * | 8/1993 | Matsuoka | 72/452.9 |
| 6,164,115 | A * | 12/2000 | Higuchi et al. | 72/452.9 |
| 6,220,137 | B1 * | 4/2001 | Matsuoka | 72/452.9 |
| 6,336,399 | B1 * | 1/2002 | Matsuoka | 72/452.9 |
| 6,619,095 | B1 * | 9/2003 | Matsuoka | 72/315 |

* cited by examiner

*Primary Examiner*—David Jones
(74) *Attorney, Agent, or Firm*—Schnader Harrison Segal & Lewis, LLP; Joan T. Kluger

(57) ABSTRACT

A press mounted cam has an adapter, slide and a driver with range of sizes and working angles provided at low cost by driver and/or adapter constructions having base plates and a series of side by side upright plates of a number corresponding to a given length with an angled top corresponding to a given working angle.

7 Claims, 13 Drawing Sheets

PRESS MOUNTED CAM AND METHOD OF MANUFACTURE

CROSS REFERENCE TO RELATED APPLICATION

This application claims the benefit of U.S. provisional Ser. No. 60/629,147, filed Nov. 18, 2004.

BACKGROUND OF THE INVENTION

This invention concerns press mounted cams, which are mechanisms installed in forming presses to produce a feature on the formed part, such as a punched or tapped hole. Where the feature must be formed by tool motion along a direction at a working angle transverse to the direction of press motion, such cams are used to produce this tool motion.

These cams are comprised of a "slide", carrying the tool, a "body" or "adapter" affixed to one of the die parts or press platens on which the slide is slidably mounted and a separate "driver" mounted on the other of the die parts or press platen. The driver engages the slide and drives the same by mating cam surfaces when the press is operated.

In an "aerial" cam shown in FIG. 1, a slide 12 is suspended on a body of adapter 10 mounted to the upper platen 2 or die part 6. A driver 14 is mounted to the lower platen 4 or die part 8 and has a fixed inclined cam surfaces 16 extending parallel to the working angle, typically defined by wear plates affixed to faces on the driver 14 and slide 12.

As the upper platen 2 descends, a resulting cam action causes the slide 12 to be advanced along the working angle against the resistance of one or more springs 15 with tooling T projecting from the slide 12 in that direction. The horizontal component of the motion requires that the working slide 12 also move laterally on the adapter 10. Engaged horizontal bearing surfaces 18, 20 are provided on the top of the slide and the bottom of the adapter 10 for this reason. In other configurations, an angled surface may be on the adapter, and a horizontal surface on the driver as the embodiment seen in FIG. 10.

In a "die" or "base" mounted cam (shown in FIG. 2) the slide 12 and adapter 10 are both mounted to the lower platen 4 or die part 8 and do not move, but rather the drive 14 mounted to the upper platen 2 or die part 6 descends to engage the slide 12.

The die mounted cam thus does not result in vertical movement of the heavy slide when the press is operated which is necessary in an aerial cam, but which can cause problems as described below. However, aerial cams are often necessarily used to create a clearance space allowing transfer of the workpiece into and out of the die.

In a conventional aerial cam, a slide 12 (FIGS. 3 and 4) is suspended on a body or adapter 10 mounted to the upper platen. A driver 14 is mounted to the lower platen and has fixed inclined cam wear surfaces 16, 16A extending parallel to the working angle, typically defined by wear plates affixed to faces on the driver and slide.

As the upper platen descends, cam action causes the slide to be advanced along the working angle with tooling projecting from the slider in that direction. The horizontal component of the motion requires that the working slide 12 also move laterally on the adapter 10. Engaged bearing surfaces 18, 20 are provided on the top of the slide and the bottom of the adapter for this reason.

In order to accurately locate the tooling, the working slider must be accurately located laterally when engaging the driver and to achieve this, the practice has been to form the lower cam surfaces 16A in a V-shape so as to provide lateral location of the slide on the driver as well as a camming surface as the slide engages the driver.

Additional flat surfaces 16B are sometimes required for larger sized aerial cams to provide adequate area to distribute the stresses imposed by the press. Precision machining of the compound sloping V-shape camming surfaces is difficult and adds substantially to the cost of making the slider 12 and driver 14.

The slider 12 is suspended on the adapter 10 by means of side plates 20 engaged with plates hooked over plates 22 attached to the sides of the slider 12. The slider 12 is guided along the plates 20, 22 when being advanced by the camming action on the slider caused by the descent of the press upper platen.

The plates 22 are confined between side walls 24 to be laterally guided. A vertical hooked bar 26 is mounted on each side to reinforce the fixing of the plates 20.

Particularly in larger sizes, the need to machine the adapter 10 and slide 12 at locations on the outside of these components requires large size machining centers, adding to substantially to the cost of manufacturing the aerial cam.

Due to the large mass of the components, an auxiliary roller cam 28 is provided to initiate and assist slider motion by engagement with a machined slot 30 on the driver 14, just prior to engagement of the cam surfaces. This helps to initiate motion of the slider prior to engagement of the cam surfaces to reduce noise, shock and wear of the cam surfaces. However, this feature also adds substantially to the cost of such aerial cams.

A positive retraction auxiliary cam comprised of cam bars 32 and 34 is also provided to insure return movement of the slide 14 if return springs in pockets 36 should fail due to excessive shock loading.

A substantial practical difficulty encountered in manufacturing such cams is the great variety of configurations needed. Availability in a large number of working angles and lengths are required. Typically, the angle between the slide upper and lower surfaces is maintained constant, and the driver and adapter angles are varied with changes in the working angle.

The adapter, slide and driver have heretofore been machined from castings, a unique casting required for each of these components for each cam configuration, which is very costly particularly in the larger sizes.

It is an object of the present invention to provide a press mounted cam which eliminates hard to machine features, and is much easier to manufacture in the large number of configurations needed so as to substantially lower its cost of manufacture.

SUMMARY OF THE INVENTION

The above object and other objects which will become apparent upon a reading of the following specification and claims are achieved by manufacturing the driver and/or the adapter of a built-up construction rather than being machined from castings. A series of parallel side by side upright plates having their upper ends cut at the required working angle are attached to a flat base plate, the number of upright plates varying depending on the length of the driver or adapter (and slide). A support plate is affixed to the angled upper ends of the upright plates to provide an inclined mounting for mounting the cam wear plates. Drivers and adapters of this construction can be produced at a much lower cost than when using castings, and can easily be made at low cost in a large number of configurations of different lengths and working angles.

The slides machined can be from a limited number of castings, cut to length as needed.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
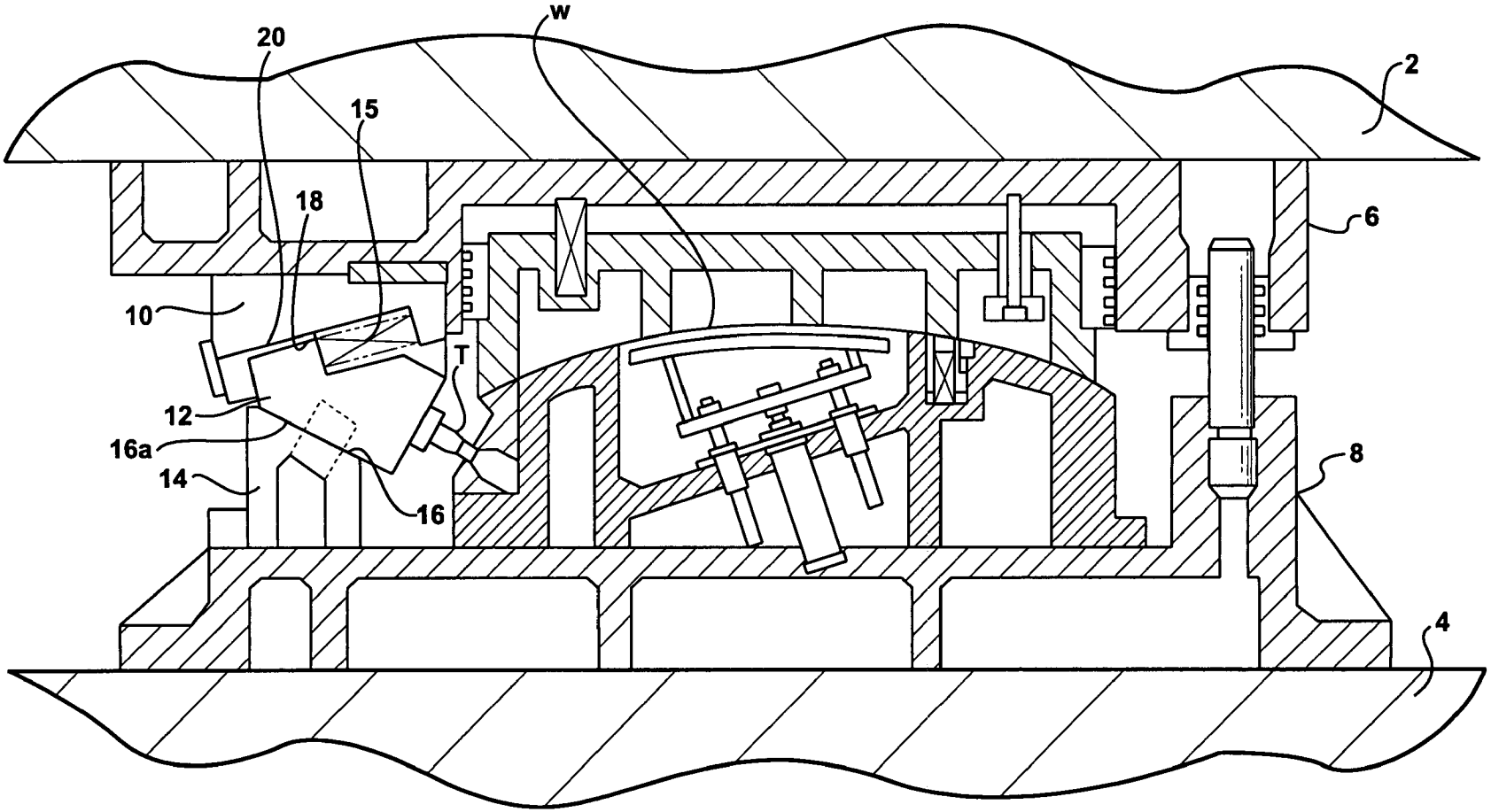
FIG. 1 is a partially sectional fragmentary view of a press and die with an aerial cam installed therein.
Figure 2:
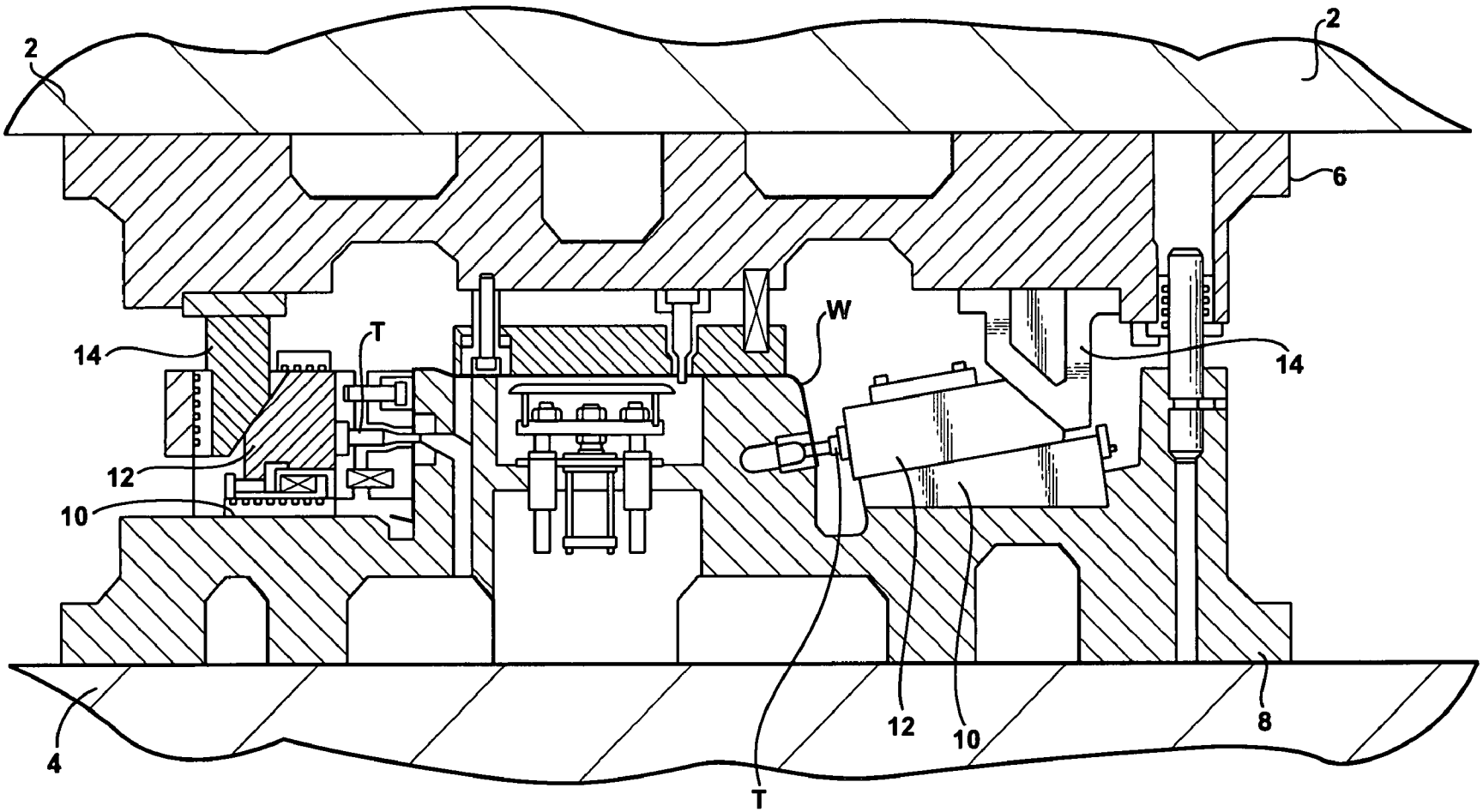
FIG. 2 is a partially sectional fragmentary view of a press and die with a die mounted cam installed therein.
Figure 3:
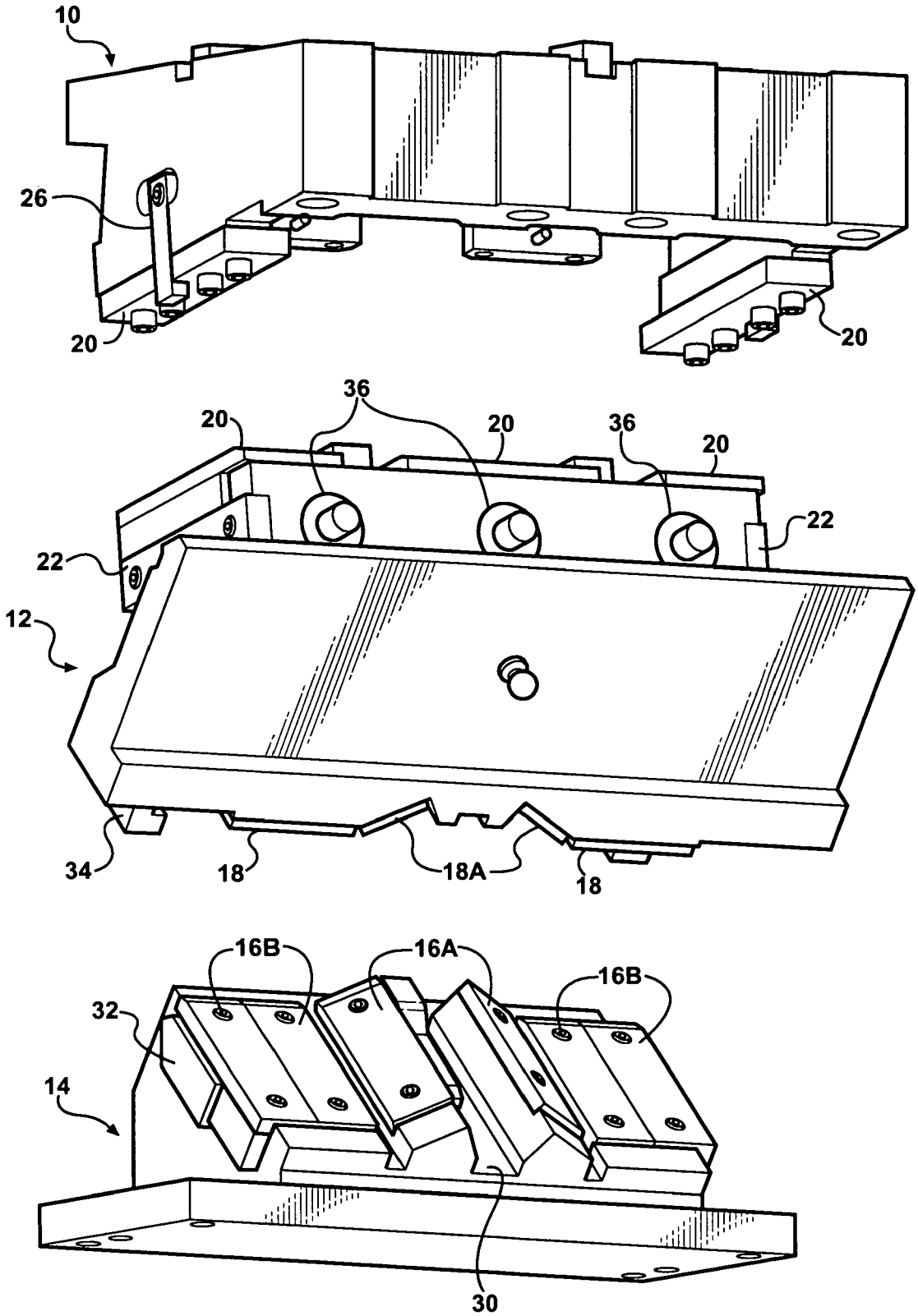
FIG - 3 PRIOR ART
FIG. 3 is an exploded pictorial view of an aerial cam of a prior design.
Figure 4:
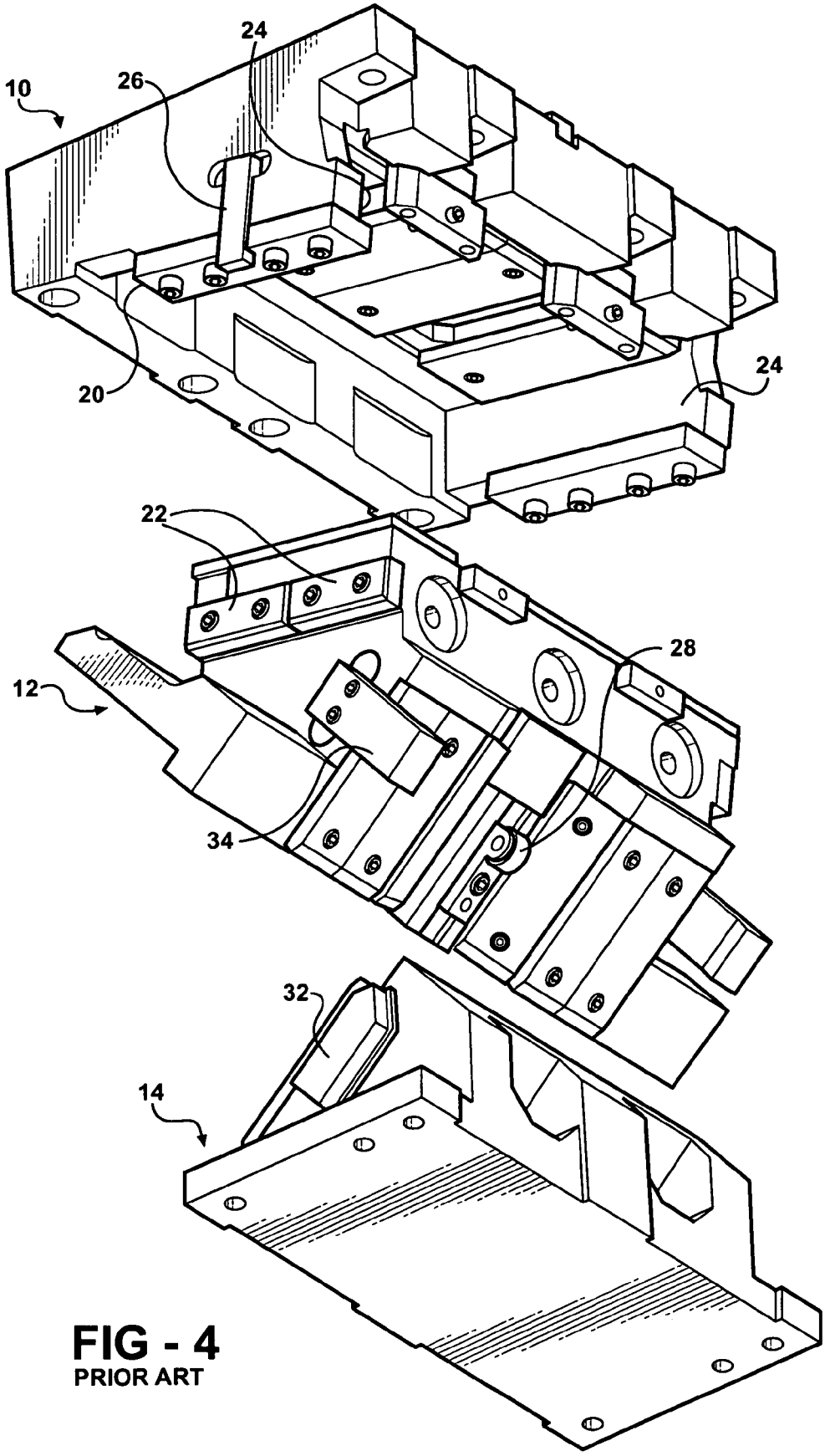
FIG - 4 PRIOR ART
FIG. 4 is a pictorial exploded reverse view of a prior aerial cam shown in FIG. 3.
Figure 5:
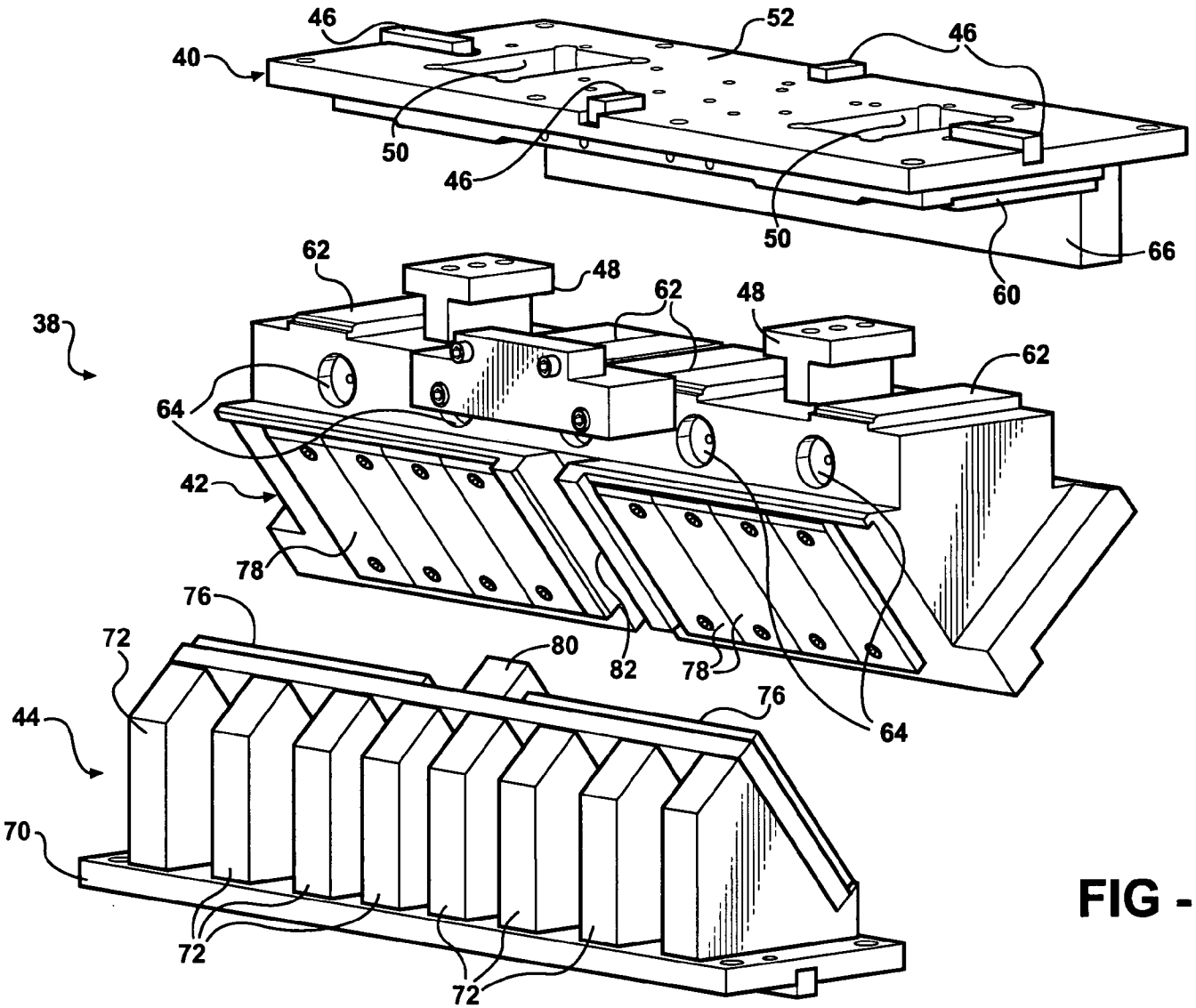
FIG. 5 is an exploded pictorial view of an aerial cam according to the present invention.
Figure 6:
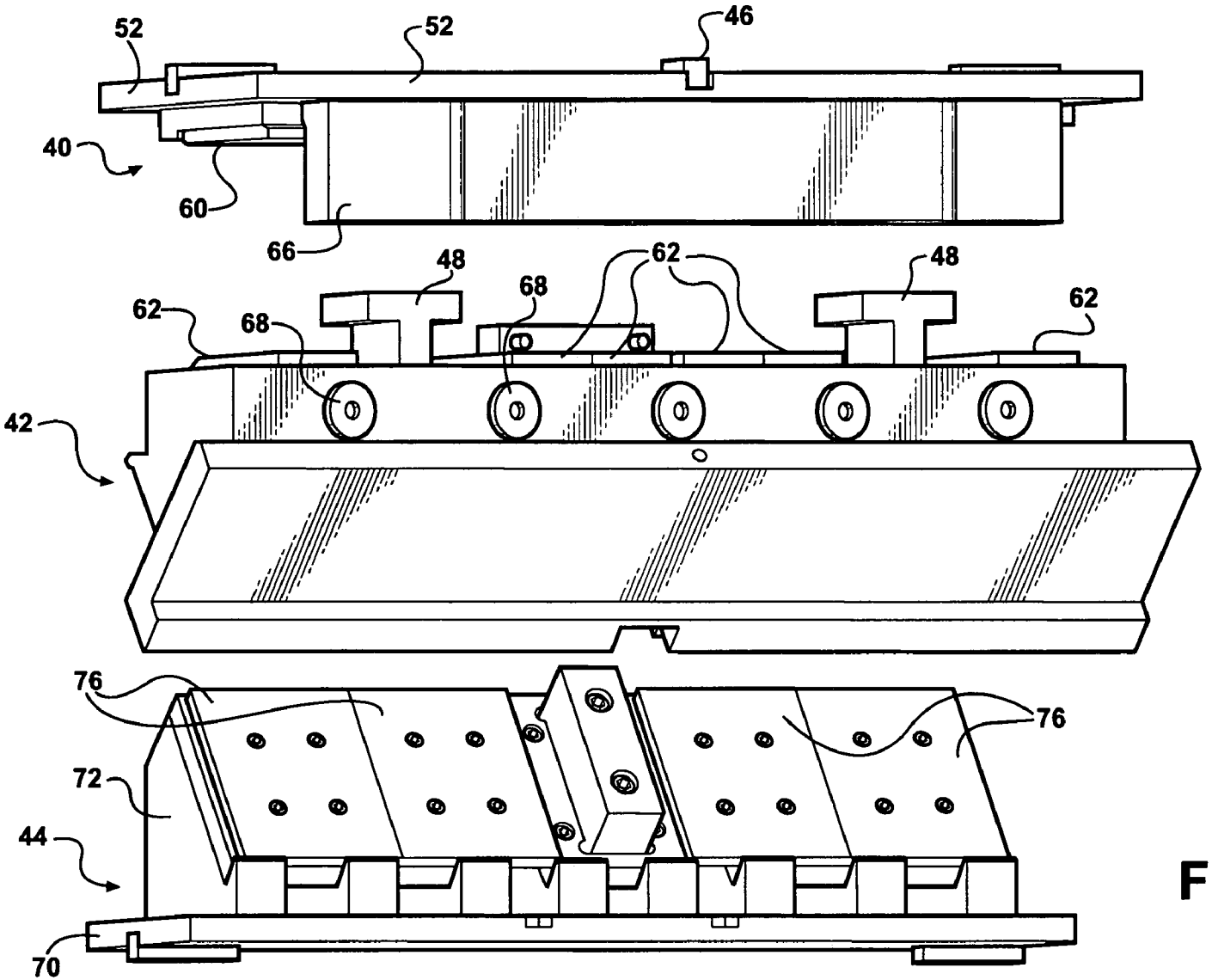
FIG. 6 is an exploded reverse pictorial view of the aerial cam shown in FIG. 5.
Figure 7:
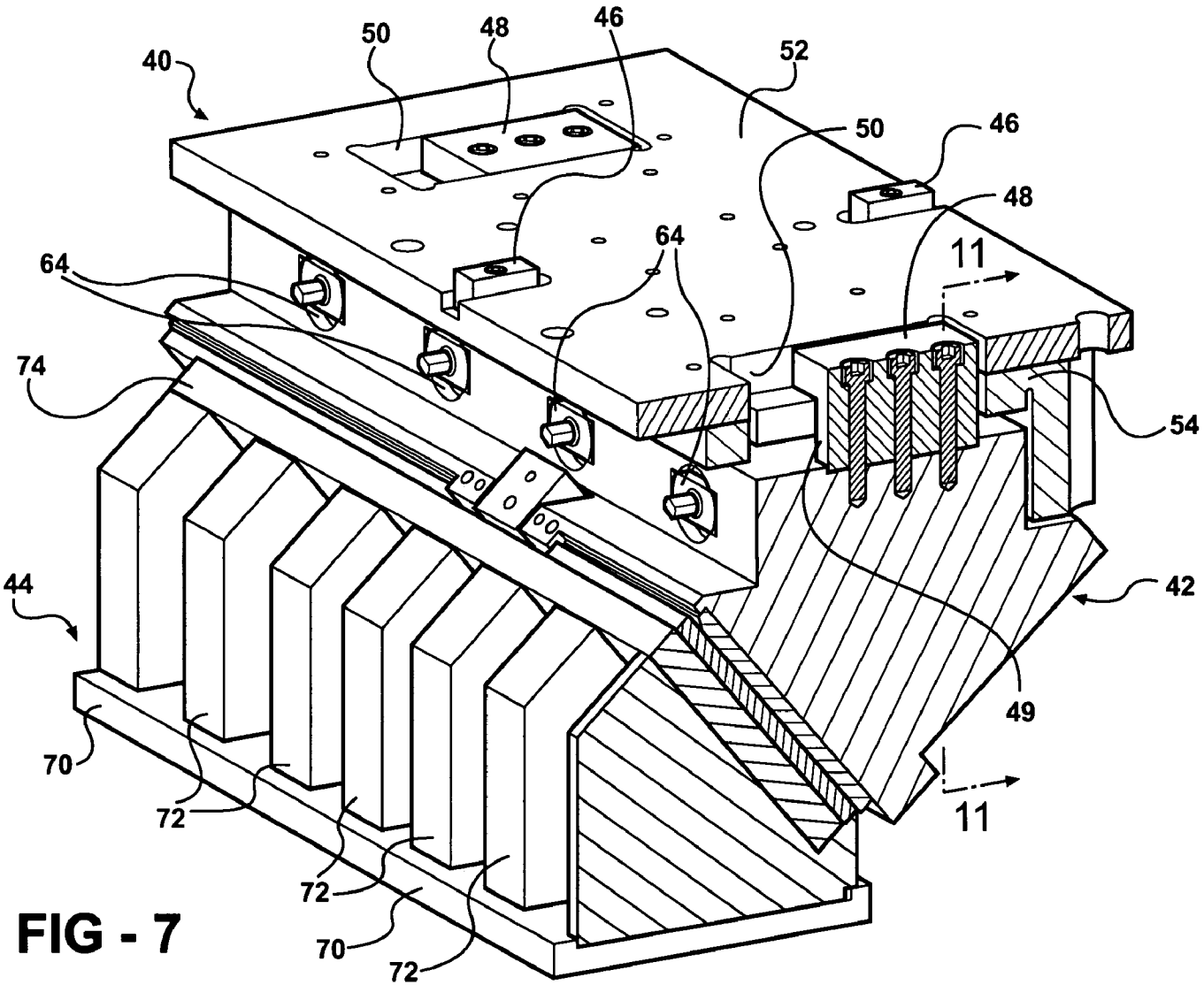
FIG. 7 is a pictorial sectional view of the aerial cam shown in FIGS. 3 and 4.

Referring to FIGS. 5–7, a cam 38 according to the present invention is shown which includes an adapter 40, a slide 42, and a driver 44. While an aerial cam is shown in that the adapter 40 and slide 42 is above the driver 44, the present invention is also applicable to die mounted cams as described above.

The adapter 40 is affixed to a press upper platen (not shown) using keys 46 to be accurately and securely positioned thereon.

The driver 44 is mounted to a press lower platen (not shown).

Figure 12:
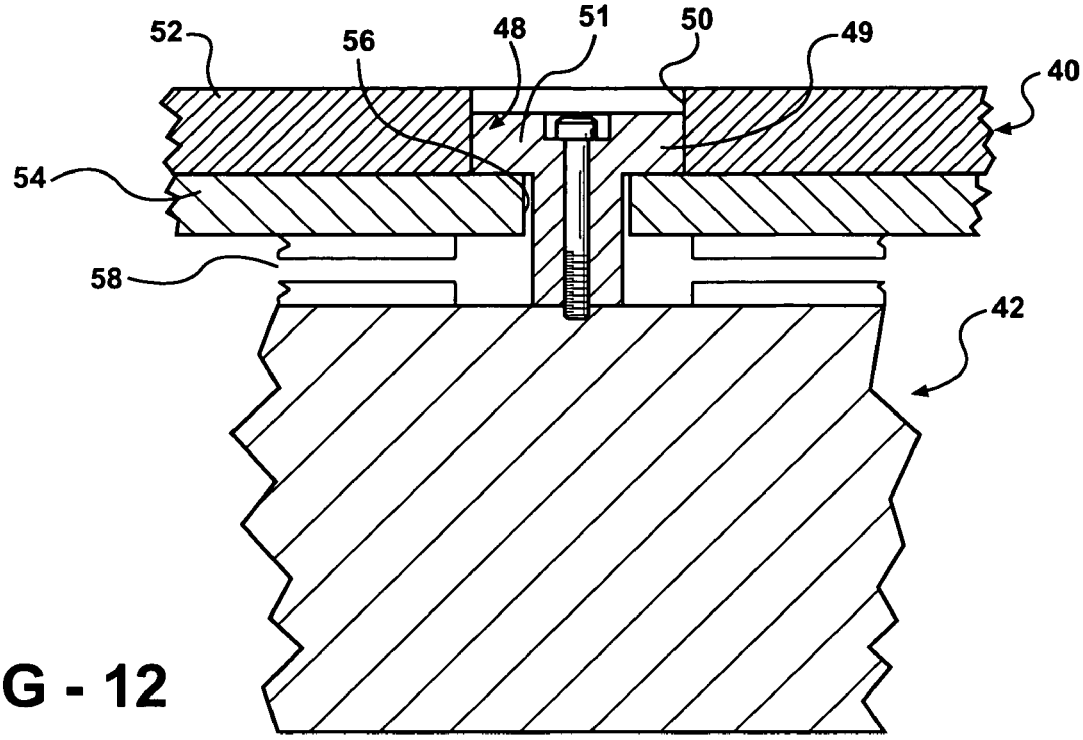
FIGS. 12 and 13 are enlarged fragmentary sectional views showing the relationship of the T blocks with the slider and driver as the press is cycled.
Figure 13:
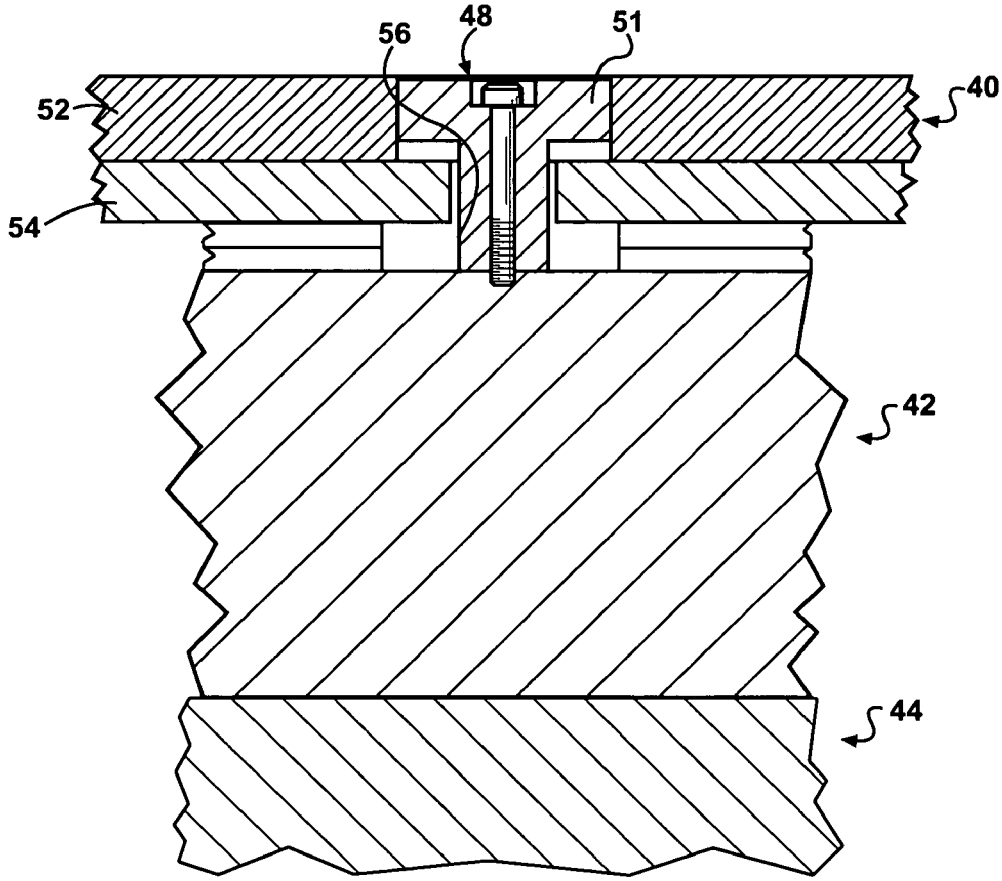

The slide 42 is suspended on the adapter 40 by a pair of inboard located T blocks 48 affixed to the upper side of the slide, and passed through slot openings 50 in a base plate 52 of the adapter 40. As seen in FIGS. 7, 12 and 13, the base plate 52 has an underplate 54 affixed thereto, with slots 56 formed therein freely receiving the narrow lower part 49 of a respective T block 48, the head portion 51 resting on surfaces adjacent the respective slot 56.

A clearance space 58 (FIG. 12) exists between the mating bearing surfaces on slide 42 and adapter 40 when the slide 42 is suspended from the adapter 40, but is eliminated after a short delay when the press motion then initially causes the engagement of the slide 42 with the driver 44 for a purpose to be described below. This clearance 58 can be relatively slight, i.e., on the order of 0.001 to 002 inches.

Figure 8A:
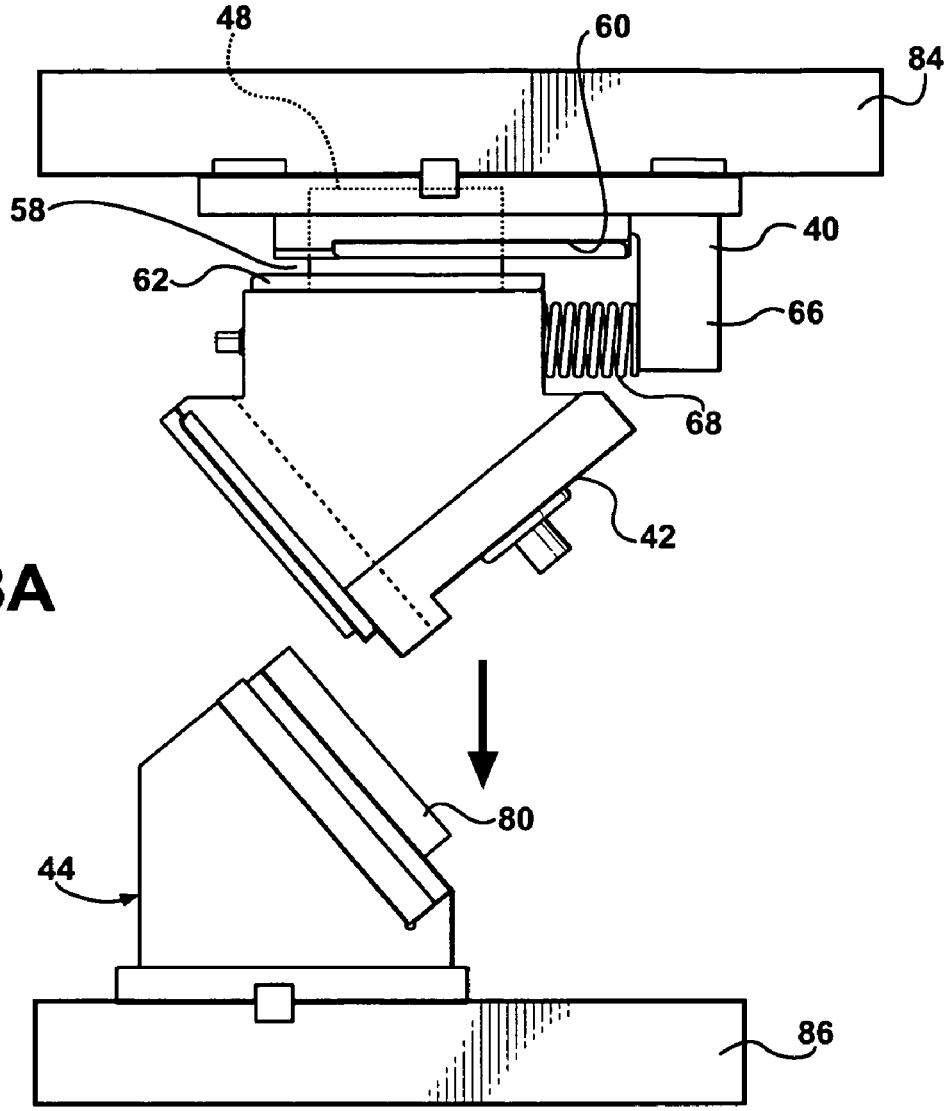
FIGS. 8A–8D are reduced size simplified views of an aerial cam according to the invention, showing successive stages in the work cycle.
Figure 8B:
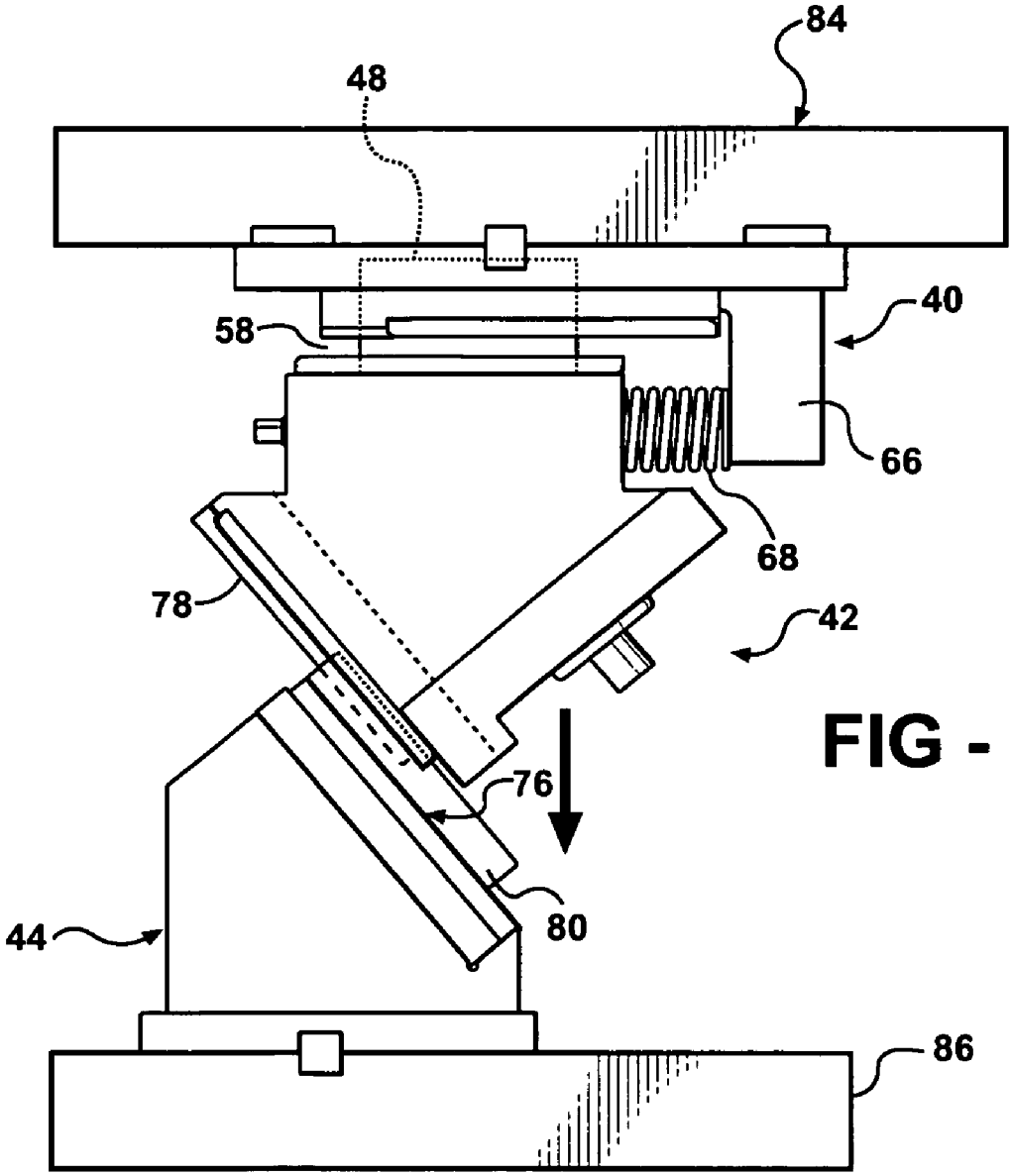
Figure 8C:
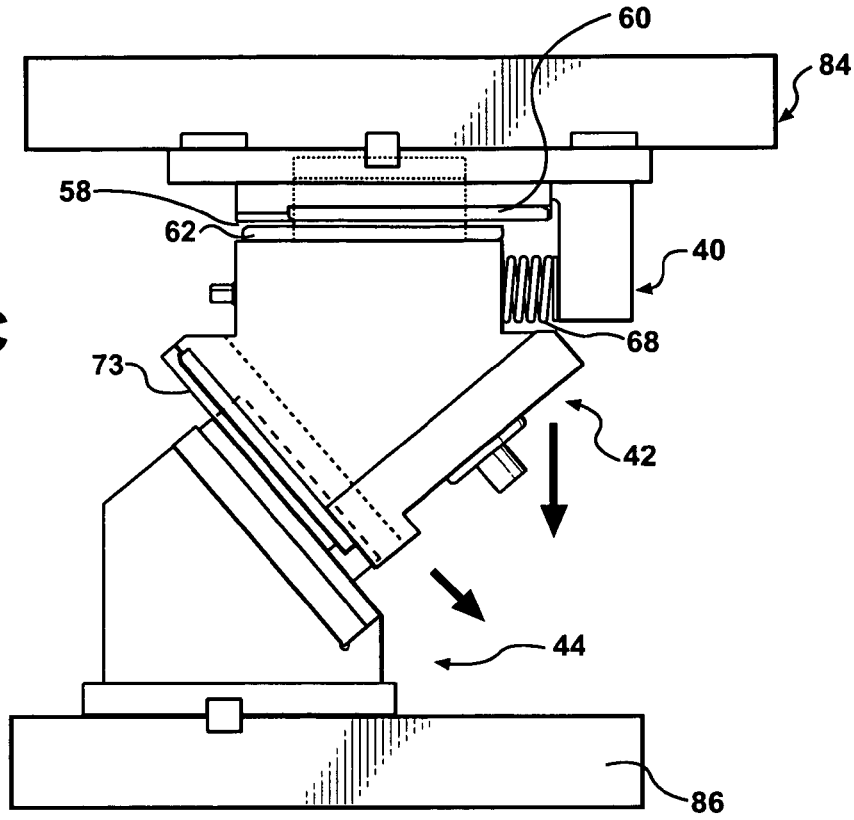
Figure 8D:
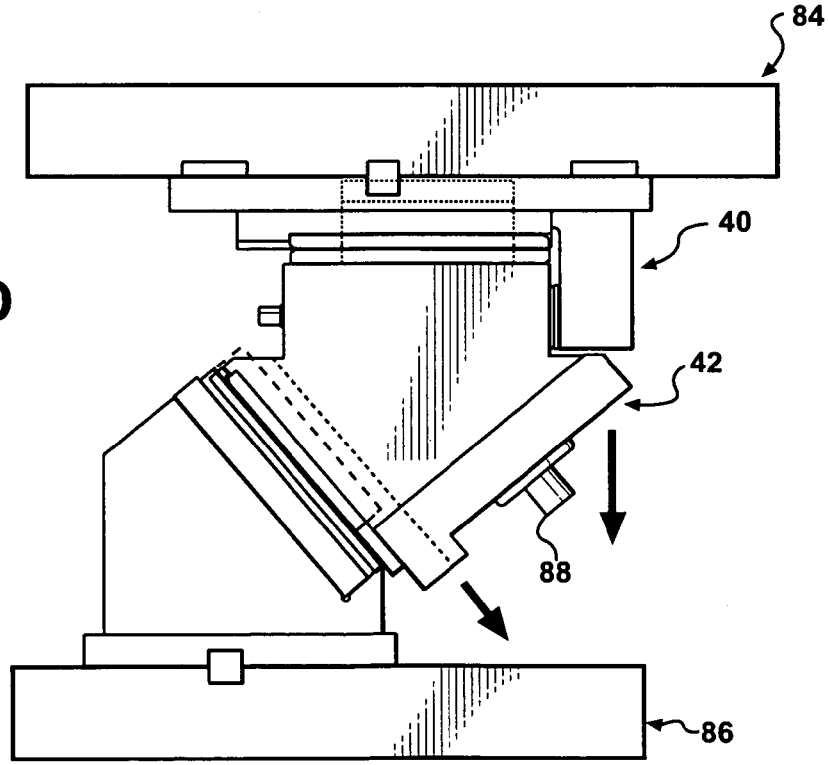

The slide 42 slides laterally on the adapter 40 in the embodiment, shown in FIGS. 5–7 when the slide 42 is shifted by engagement with the driver 44 as the upper press platen descends as seen in FIGS. 8B–8D.

A set of wear plates 60 on the adapter 40 rides on a mating set of wear plates 62 on the upper side of the slide 42.

As will be discussed below, the angle of the engagement surface on the adapter 40 changes with the working angle of the driver 44 since the included angle of the slide 42 typically remains constant with changes in the working angle. Thus, the wear plates on the adapter 40 will be inclined down from horizontal as the working angle becomes shallower.

The lateral component of the motion of the slide 42 relative the adapter 40 proceeds against the resistance of a series of compression springs 68 in pockets 64 formed in the slide 42, the springs 68 projecting out against end wall 66 of the adapter 40.

A closure lock as described in copending U.S. application Ser. No. 10/954,960, filed on Sep. 29, 2004 may be employed if nitrogen springs are used.

A combination mechanical spring may be used instead of nitrogen springs as described in U.S. application Ser. No. 10/936,213, filed on Sep. 7, 2004.

According to the teaching of the present invention, the driver 44 is of a segmented, built up construction comprised of a flat base plate 70, having a side by side series of parallel upright flat plates 72 affixed to the upper surface. The length and working angles are easily varied by changing the configuration and number of plates 72 and the size of the base plate 70. This construction is much cheaper than producing a new casting for each configuration particularly considering that a separate mold must be designed and built for each configuration.

A support plate 74 is affixed to the upright plates 72 held at the working angle by the angled upper ends of the upright plates 72.

Cam wear plates 76 are secured to the support plate 74.

The inclined lower side of the slide 42 is provided with mating cam wear plates 78.

An upwardly projecting central locator key 80 is affixed to the driver 44, aligned with a central slot 82 in the lower side of the slide 42.

The locator key 80 is located and configured to move into the slot 82 as the upper platen lowers the slide 42 onto the driver 44 but before engagement of the cam wear plates 76, 78. This laterally locates the slide 42 and guides it after the slide 42 is advanced along the working angle by the platen motion and engagement of the cam wear plates 76, 78.

FIGS. 8A–8D, 12 and 13 illustrate the working of a cam according to the invention.

In the initial condition, the slide 42 is suspended below the adapter 40 by the T blocks, with a clearance space 58 therebetween.

As the upper platen 84 descends towards the lower platen 86, the locator key 80 enters the slot 82 to provide lateral location and guidance, as seen in FIG. 8B.

The clearance space 58 is then still present, and the cam wear plates 76, 78 have not yet engaged.

Continued descent of the upper platen 84 brings the cam wear plates 76, 78 into initial contact as seen in FIG. 8C. The clearance space 58 still exists, although now being reduced.

This initial contact causes the momentum of the slide 42 to be absorbed by driver 44 and results in initiation of the camming motion of the slide 42, as indicated by the lateral motion of the slide 42, compressing spring 68.

It should be noted that the extent of this motion and the size of the clearance space 58 is shown exaggerated in order to be readily visible in the drawings.

Figure 9:
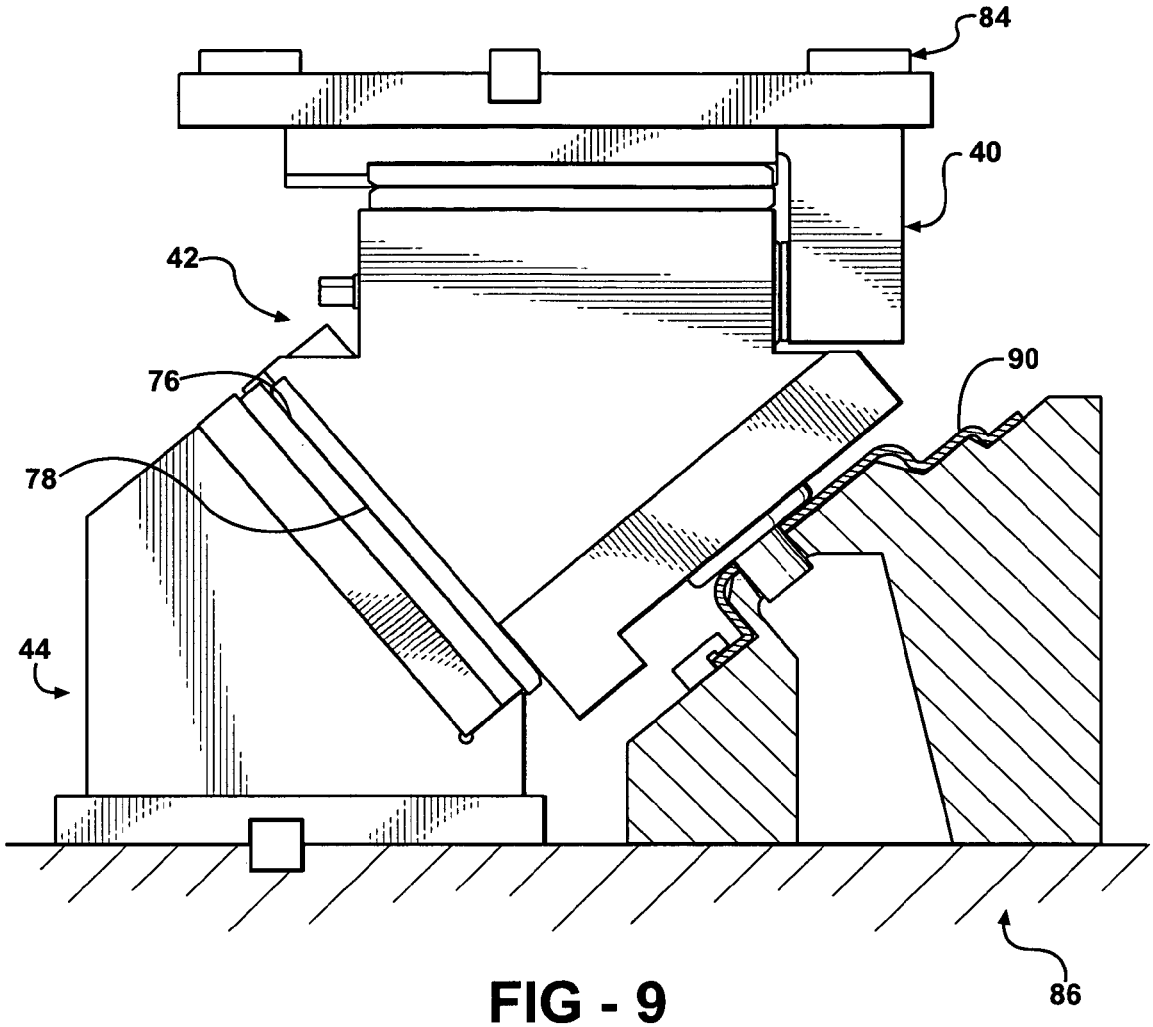
FIG. 9 is a diagrammatic view of the aerial cam shown in FIGS. 8A–8D, in the fully advanced position.

The next stage, shown in FIG. 8D shows that the clearance space 58 has now been completely eliminated, and the press forces exerted by the upper platen 84 cause continued camming advance of the slide 42 along the working angle. This drives the tooling 88 into contact with a workpiece 90, fully compressing the spring 68 in the advanced position, as indicated diagrammatically in FIG. 9.

Thus, in the initial engagement of the wear plates 76, 78 only the momentum of the slide 42 is absorbed, and the positive press drive force is momentarily delayed until the clearance 58 is taken up. This reduces shock and noise, and obviates the need for auxiliary cam rollers, formerly used, and is described and claimed in copending application U.S. Ser. No. 11/069,828, filed on Feb. 28, 2005.

Figure 10:
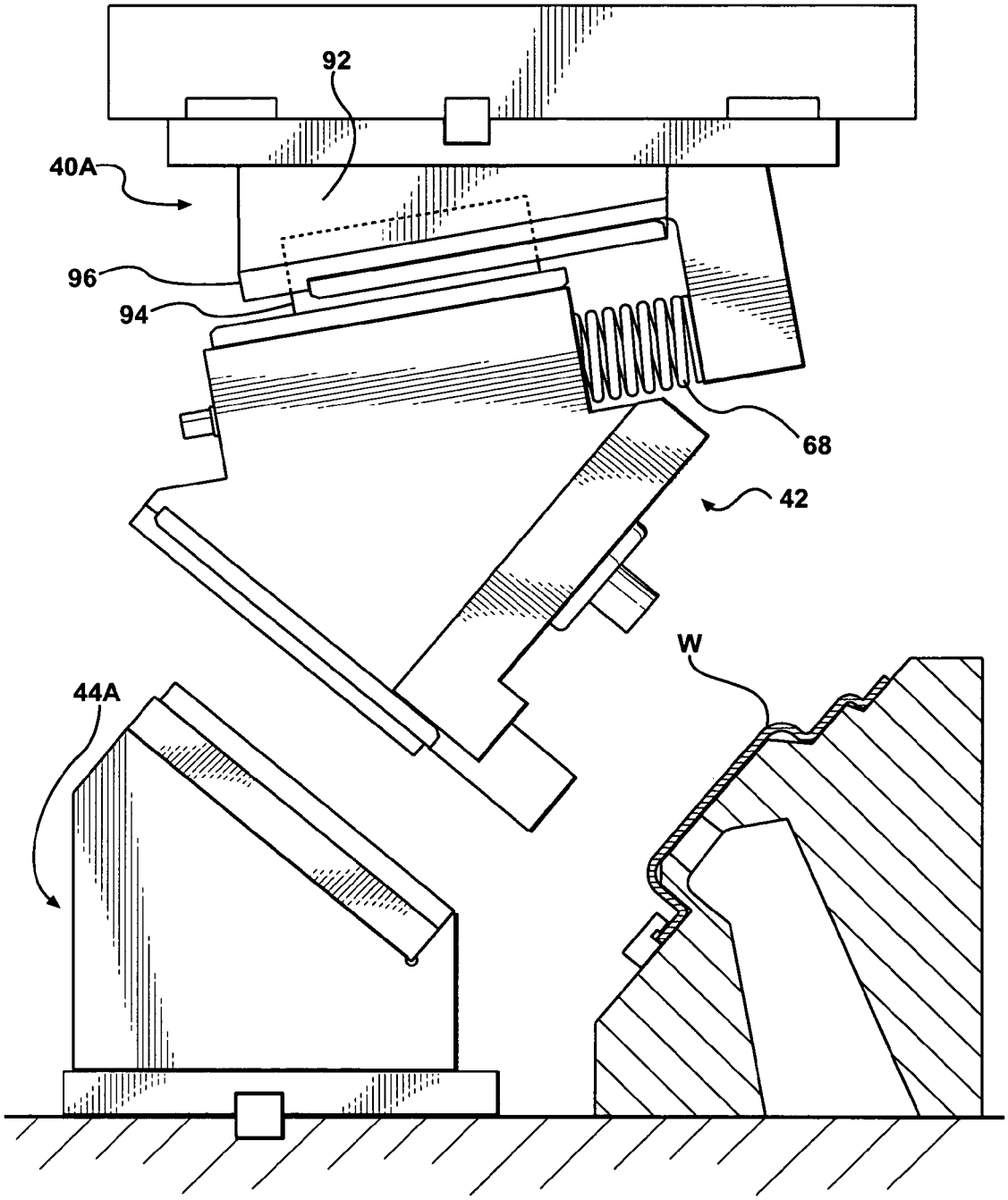
FIG. 10 is a diagrammatic view of an aerial cam according to the invention of a different configuration, showing a workpiece to be formed in a fixture.

As noted, if the working angle is shallower, the adapter 40A will have an inclined wear plates as seen in FIG. 10, and in this case, the adapter 40A may also be constructed using a parallel series of plates 92 cut at an angle to incline a support plate 94, in similar fashion to the driver 44A. The T block 96 passes through a slot in the support plate 94 and rides on the surface of the support plate 94. The same initial clearance is provided as indicated.

Figure 11:
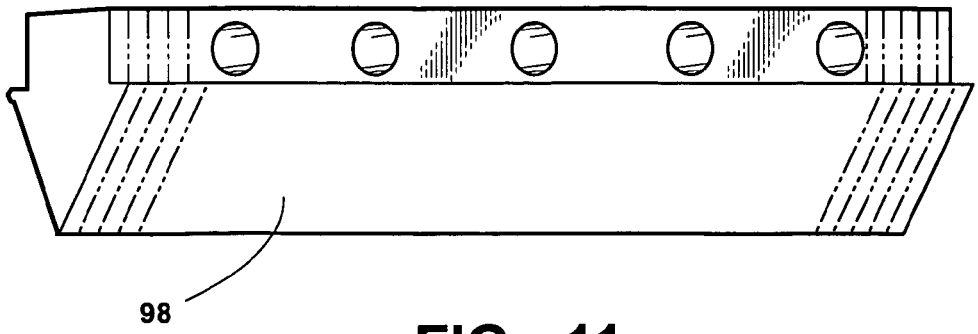
FIG. 11 is a pictorial view of a slide used in the aerial cam according to the invention illustrating with phantom lines how a common casting can be shortened by cutting off one or both ends to produce slides of different lengths.

The slide 42 is contemplated as being made from a casting. However, a common casting can be used for several length sizes by sawing off portions 42A of the casting as indicated in FIG. 11 by the broken lines to reduce the total number of casting lengths required.

If the driver has horizontal wear plates for steeply angled adapters, then the driver may be configured in a similar way as to the adapter.

Accordingly, a press mounted cam can be economically manufactured in a great number of sizes and working angles.

The invention claimed is:

1. In a cam for installation in a forming press including:

an adapter configured to be mounted so as to be supported by a press platen;

a slide mounted on said adapter to be guided thereon while undergoing limited lateral movement thereon;

a driver adapted to be mounted to be supported by another press platen aligned with said adapter and slide;

said driver having a sloping cam surfaces drivingly engaging a sloping cam surface on said slide upon continued descending movement of an upper press platen and causing lateral movement of said slide on said adapter to carry out a forming process with tooling on said slider, the improvement wherein one of said driver or adapter includes a base plate mountable to be supported on a press platen, a segmented series of side by side parallel upright plates affixed to said base plate, said upright plates each having an upper end inclined at a working angle, with a support plate attached thereto, and wear plates mounted thereon defining said driver cam surfaces.

2. The cam according to claim 1 further including a projecting locator key affixed to said driver aligned with a channel formed in said slide, said locator-guide key moving into said slot as said slide descends towards said driver prior to engagement of said cam surfaces.

3. The cam according to claim 2 wherein both said adapter and driver include a base plate mountable to a respective press platen and a series of side by side upright plates having a support plate affixed to the upper ends thereof, and wear plates attached thereto.

4. A method of constructing press mounted cams of a range of sizes and working angles each having an adapter mountable to one platen of a press, a slide suspended on said adapter, and a separate driver mountable on another platen of a press, including:

for each size and working angle cam, constructing a driver for each size and working angle by assembling a side by side segmented series of parallel upright plates onto a base plate of a length mountable to said one press platen, the length of the base plate and the number of upright plates matched to the length of a given cam, each upright plate affixed to a support plate extending along said side by side series of upright plate and inclined at the working angle for a given cam.

5. The method according to claim 4 wherein said adapters are each constructed by assembling a side by side series of parallel upright plates onto a base plate of a length mountable to an upper press platen, the length of the base plate and the number of upright plates matched to the length of a given cam, each upright plate affixed to a support plate extending along said side by side series of upright plate and inclined at the working angle for a given cam.

6. The method according to claim 4 further including:

making a series of castings of different lengths from which slides can be machined of a constant side angles, and cutting shorter lengths from each casting length from which a series of slides of different lengths are machined to provide a complete series of slide lengths.

7. A method of constructing press mounted cams of a range of sizes and working angles each having an adapter mountable to one platen of a press, a slide suspended on said adapter, and a separate driver mountable on another platen of a press, including:

for each size and working angle cam, constructing a driver for each size and working angle by assembling a side by side series of parallel upright plates onto a base plate of a length mountable to said one press platen, the length of the base plate and the number of upright plates matched to the length of a given cam, each upright plate affixed to a support plate extending along said side by side series of upright plate and inclined at the working angle for a given cam; and making a series of castings of different lengths from which slides can be machined of a constant side angle, and cutting shorter lengths from each casting length from which a series of slides of different lengths are machined to provide a complete series of slide lengths.

* * * * *

UNITED STATES PATENT AND TRADEMARK OFFICE

CERTIFICATE OF CORRECTION

PATENT NO. : 7,080,542 B2
APPLICATION NO. : 11/060082
DATED : July 25, 2006
INVENTOR(S) : Victor L. Chun et al.

It is certified that error appears in the above-identified patent and that said Letters Patent is hereby corrected as shown below:

Title Page # 75
Add the following inventors:

Joseph Mouzaya
Jack Byers

Remove the following inventor:

Frank Madej

Signed and Sealed this

Thirteenth Day of February, 2007

JON W. DUDAS
*Director of the United States Patent and Trademark Office*